US011715613B2

(12) United States Patent
Morelli et al.

(10) Patent No.: US 11,715,613 B2
(45) Date of Patent: Aug. 1, 2023

(54) MEDIUM VOLTAGE SWITCHING APPARATUS

(71) Applicant: ABB Schweiz AG, Baden (CH)

(72) Inventors: Emanuele Morelli, Azzano San Paolo (IT); Jacopo Bruni, Caselle Lurani (IT); Corrado Rizzi, Fornovo S. Giovanni (IT); Giorgio Forlani, Romano di Lombardia (IT)

(73) Assignee: ABB Schweiz AG, Baden (CH)

( * ) Notice: Subject to any disclaimer, the term of this patent is extended or adjusted under 35 U.S.C. 154(b) by 0 days.

(21) Appl. No.: 17/678,787

(22) Filed: Feb. 23, 2022

(65) Prior Publication Data

US 2022/0285110 A1 Sep. 8, 2022

(30) Foreign Application Priority Data

Mar. 3, 2021 (EP) ..... 21160404

(51) Int. Cl.
*H01H 33/12* (2006.01)
*H01H 33/666* (2006.01)
*H01H 3/32* (2006.01)

(52) U.S. Cl.
CPC ..... *H01H 33/6661* (2013.01); *H01H 33/122* (2013.01); *H01H 33/128* (2013.01); *H01H 2003/323* (2013.01)

(58) Field of Classification Search
CPC .... H01H 33/122; H01H 33/128; H01H 33/66; H01H 33/6661; H01H 33/6606;
(Continued)

(56) References Cited

U.S. PATENT DOCUMENTS 4,168,417 A 9/1979 Puetz et al.
4,814,559 A 3/1989 Stegmuller
(Continued)

FOREIGN PATENT DOCUMENTS

DE 3528770 A 2/1987
DE 39516461 T2 10/2000
(Continued)

OTHER PUBLICATIONS

Extended European Search Report issued in European application No. 21160404.6, dated Sep. 2, 2021, 7 pages.

*Primary Examiner* — William A Bolton
(74) *Attorney, Agent, or Firm* — Armstrong Teasdale LLP

(57) ABSTRACT

Disclosed herein is a switching apparatus for medium voltage electric systems, said switching apparatus including one or more electric poles. For each electric pole, said switching apparatus includes: a first pole terminal, a second pole terminal, and a ground terminal; a first fixed contact member and a first movable contact member, said first fixed contact member being electrically connected to said first pole terminal and including a first fixed contact, said first movable contact member being electrically connected to said second pole terminal and including a first movable contact; a second fixed contact member and a second movable contact member, said second fixed contact member being electrically connected to said first pole terminal and including a second fixed contact, said second movable contact member including a second movable contact; a vacuum chamber, in which said second fixed contact and said second movable contact are enclosed; and a motion transmission mechanism.

18 Claims, 12 Drawing Sheets

(58) Field of Classification Search
CPC .. H01H 33/664; H01H 33/6664; H01H 31/28; H01H 31/003; H01H 3/42; H01H 3/3047; H01H 2003/323
USPC ..... 218/154–156, 120, 140, 153
See application file for complete search history.

(56) References Cited

U.S. PATENT DOCUMENTS

| | | | | |
|---|---|---|---|---|
| 5,591,948 | A | 1/1997 | Bolongeat-Mobleu et al. | |
| 5,644,117 | A | 7/1997 | Bolongeat-Mobleu et al. | |
| 9,251,972 | B2 * | 2/2016 | Belloni | H01H 33/66207 |
| 9,362,061 | B2 * | 6/2016 | Endre | H01H 33/125 |

FOREIGN PATENT DOCUMENTS

| | | | |
|---|---|---|---|
| DE | 39517740 | T2 | 2/2001 |
| EP | 2845213 | A1 | 3/2015 |
| FR | 747866 | A | 6/1933 |
| FR | 2744284 | A1 | 8/1997 |
| GB | 2129617 | A | 5/1984 |
| WO | 2006074975 | A1 | 7/2006 |
| WO | 2020200864 | A1 | 10/2020 |

* cited by examiner

Stable Condition C1 – Closed State

First end-of-run position $P_A$

Coupling position P1

First switch position S1

Transitory Condition C11

Transitory Condition C12

Stable Condition C2 – Open State

Intermediate position $P_B$

Decoupling position P2

Second switch position S2

Stable Condition C3 - Grounded state

Second end-of-run position $P_C$

Decoupling position P2

Second switch position S2

Transitory Condition C21

Transitory Condition C22

MEDIUM VOLTAGE SWITCHING APPARATUS

CROSS REFERENCE TO RELATED APPLICATION

The present application claims priority to European Patent Application No. 21160404.6, filed on Mar. 3, 2021, and titled "A MEDIUM VOLTAGE SWITCHING APPARATUS", which is hereby incorporated by reference in its entirety.

BACKGROUND

The present disclosure relates to a switching apparatus for medium voltage electric systems, more particularly to a load-break switch for medium voltage electric systems.

Load-break switches are well known in the state of the art.

These switching apparatuses, which are generally used in secondary distribution electric grids, are capable of providing circuit-breaking functionalities (namely breaking and making a current) under specified circuit conditions (typically nominal or overload conditions) as well as providing circuit-disconnecting functionalities (namely grounding a load-side section of an electric circuit).

Most traditional load-break switches of the state of the art have their electric poles immersed in a sulphur hexafluoride ($SF_6$) atmosphere as this insulating gas ensures excellent performances in terms of dielectric insulation between live parts and arc-quenching capabilities when currents are interrupted.

As is known, however, $SF_6$ is a powerful greenhouse gas and its usage is subject to severe restriction measurements for environmental preservation purposes. For this reason, over the years, there has been made a considerable effort to develop and design load-break switches not employing $SF_6$ as an insulating gas.

Some load-break switches have been developed, in which electric poles are immersed in pressurized dry air or in an environment-friendly insulation gas, such as mixtures of oxygen, nitrogen, carbon dioxide and/or fluorinated gases. Unfortunately, the experience has shown that these switching apparatuses generally do not show fully satisfactory performances, particularly in terms of arc-quenching capabilities.

Other currently available load-break switches employ, for each electric pole, different contact arrangements electrically connected in parallel between the pole terminals.

A contact arrangement has electric contacts operating in an atmosphere filled with an environment-friendly insulating gas or air and it is designed for carrying most of the current flowing along the electric pole as well as driving possible switching maneuvers.

Another contact arrangement, instead, has electric contacts operating in a vacuum atmosphere and it is specifically designed for quenching the electric arcs arising when the current flowing along the electric pole is interrupted.

These switching apparatuses have proven to ensure a relatively low environmental impact while providing, at the same time, high-level performances in terms of dielectric insulation and arc-quenching capabilities. However, until now, they adopt complicated solutions to manage and coordinate the operation of the above-mentioned multiple contact arrangements. Therefore, they still offer poor performances in terms of structural compactness and reliability in operation.

BRIEF DESCRIPTION

Embodiments of the present disclosure provide a switching apparatus for MV electric systems that allows solving or mitigating the above-mentioned technical problems.

More particularly, embodiments of the present disclosure provide a switching apparatus ensuring high-level performances in terms of dielectric insulation and arc-quenching capabilities during the current breaking process.

Embodiments of the present disclosure also provide a switching apparatus showing high levels of reliability in operation.

Additionally, embodiments of the present disclosure provide a switching apparatus having electric poles with high compactness and structural simplicity.

Further, embodiments of the present disclosure provide a switching apparatus that can be easily manufactured at industrial level, at competitive costs with respect to the solutions of the state of the art.

Finally, embodiments of the present disclosure provide a switching apparatus, according to the following claim 1 and the related dependent claims.

In a general definition, the switching apparatus of the present disclosure includes one or more electric poles.

For each electric pole, the switching apparatus includes a first pole terminal, a second pole terminal and a ground terminal. In operation, the first pole terminal can be electrically coupled to a first conductor of an electric line, the second pole terminal can be electrically coupled to a second conductor of said electric line and the ground terminal can be electrically coupled to a grounding conductor.

For each electric pole, the switching apparatus includes a first fixed contact member and a first movable contact member.

The first fixed contact member is electrically connected to the first pole terminal and it includes a first fixed contact.

The first movable contact member is electrically connected to the second pole terminal and it includes a first movable contact.

The first movable contact member is reversibly movable about a corresponding first rotation axis according to a first rotation direction, which is oriented away from the first fixed contact and towards the above-mentioned ground terminal, or according to a second rotation direction, which is opposite to said first rotation direction and therefore oriented away from the ground terminal and towards the first fixed contact.

Since the first movable contact member can be moved about the above-mentioned first rotation axis, the first movable contact can be coupled to or uncoupled from the first fixed contact or can be coupled to or uncoupled from the ground terminal.

For each electric pole, the switching apparatus includes a second fixed contact member and a second movable contact member.

The second fixed contact member is electrically connected to the first pole terminal and includes a second fixed contact.

The second movable contact member includes a second movable contact and is reversibly movable along a corresponding translation axis.

Since the second movable contact member can be moved along the above-mentioned translation axis, the second movable contact can be coupled to or decoupled from the second fixed contact. In particular, the second contact member reversibly movable, along the above-mentioned translation axis, between a coupling position, at which said second movable contact is coupled to said second fixed contact, and a decoupled position, at which said second movable contact is decoupled from said second fixed contact.

For each electric pole, the switching apparatus includes a vacuum chamber, in which the above-mentioned second fixed contact and second movable contact are enclosed and are coupled or decoupled.

According to the present disclosure, the switching apparatus includes, for each electric pole, a motion transmission mechanism for actuating the second movable contact member of said electric pole.

Such a motion transmission mechanism includes:

a cam member movable about a second rotation axis and coupled to the second movable contact member. Said cam member is adapted to exert, on the second movable contact member, actuation forces moving said second movable contact member along said translation axis between the above-mentioned first and second coupling positions, when said cam member rotates about said second rotation axis. Said cam member is electrically conductive and electrically connected to said second movable contact member;

a first lever arm coupled to said cam member and extending radially with respect to said second rotation axis. Said first lever arm is electrically conductive and electrically connected to said second movable contact member;

a second lever arm coupled to said cam member and extending radially with respect to said second rotation axis and angularly spaced with respect to said first lever arm.

Said cam member is reversibly movable between a first switch position, which corresponds to a coupling position of the second movable contact member, and a second switch position, which corresponds to a decoupled position of the second movable contact member, upon actuation of the first lever arm or the second lever arm by the first movable contact member, during an opening or closing maneuver of the switching apparatus.

According to an aspect of the present disclosure, the first movable contact member couples to and actuates the first lever arm to move the cam member from the first switch position to the second switch position, when the first movable contact member moves according to the first rotation direction, during an opening maneuver of the switching apparatus.

According to an aspect of the present disclosure, the first movable contact member couples to and actuates the second lever arm to move the cam member from the second switch position to the first switch position, when the first movable contact member moves according to the second rotation direction, during a closing maneuver of the switching apparatus.

According to an aspect of the present disclosure, the motion transmission mechanism electrically connects the second movable contact member with the first movable contact member, when the first movable contact member is coupled to the first lever arm.

According to an aspect of the present disclosure, the cam member includes one or more coupling surfaces with the second movable contact member. Said coupling surfaces have an eccentric profile with respect to the second rotation axis.

The first lever arm may be at least partially made of electrically conductive material.

The first lever arm may include a main body and a conductive element coupled to the main body and electrically connected with said cam member or with a conductive portion of the main body electrically connected to the cam member. Said conductive element is in contact with the first movable contact member, when the first movable contact member is coupled to the first lever arm.

The second lever arm may be made of electrically insulating material.

The motion transmission mechanism may include biasing means to favor the switch of said cam member in said first switch position or said second switch position, when the first lever arm or the second lever arm is actuated by the first movable contact member.

Further characteristics and advantages of the present disclosure will emerge from the description of example, but not exclusive embodiments of the switching apparatus, according to the present disclosure, non-limiting examples of which are provided in the attached drawings.

DETAILED DESCRIPTION

With reference to the figures, the present disclosure relates to a switching apparatus 1 for medium voltage electric systems.

For the purpose of the present application, the term "medium voltage" (MV) relates to operating voltages at electric power distribution level, which are higher than 1 kV AC and 1.5 kV DC up to some tens of kV, e.g. up to 72 kV AC and 100 kV DC.

The switching apparatus 1 is particularly adapted to operate as a load-break switch. It is therefore designed for providing circuit-breaking functionalities under specified circuit conditions (nominal or overload conditions) as well as circuit-disconnecting functionalities, in particular grounding a load-side section of an electric circuit.

The switching apparatus 1 includes one or more electric poles 2.

The switching apparatus 1 may be of the multi-phase (e.g. three-phase) type and it may include a plurality (e.g. three) of electric poles 2.

The switching apparatus 1 may include an insulating housing 4, which conveniently defines an internal volume where the electric poles 2 are accommodated.

Figure 1:
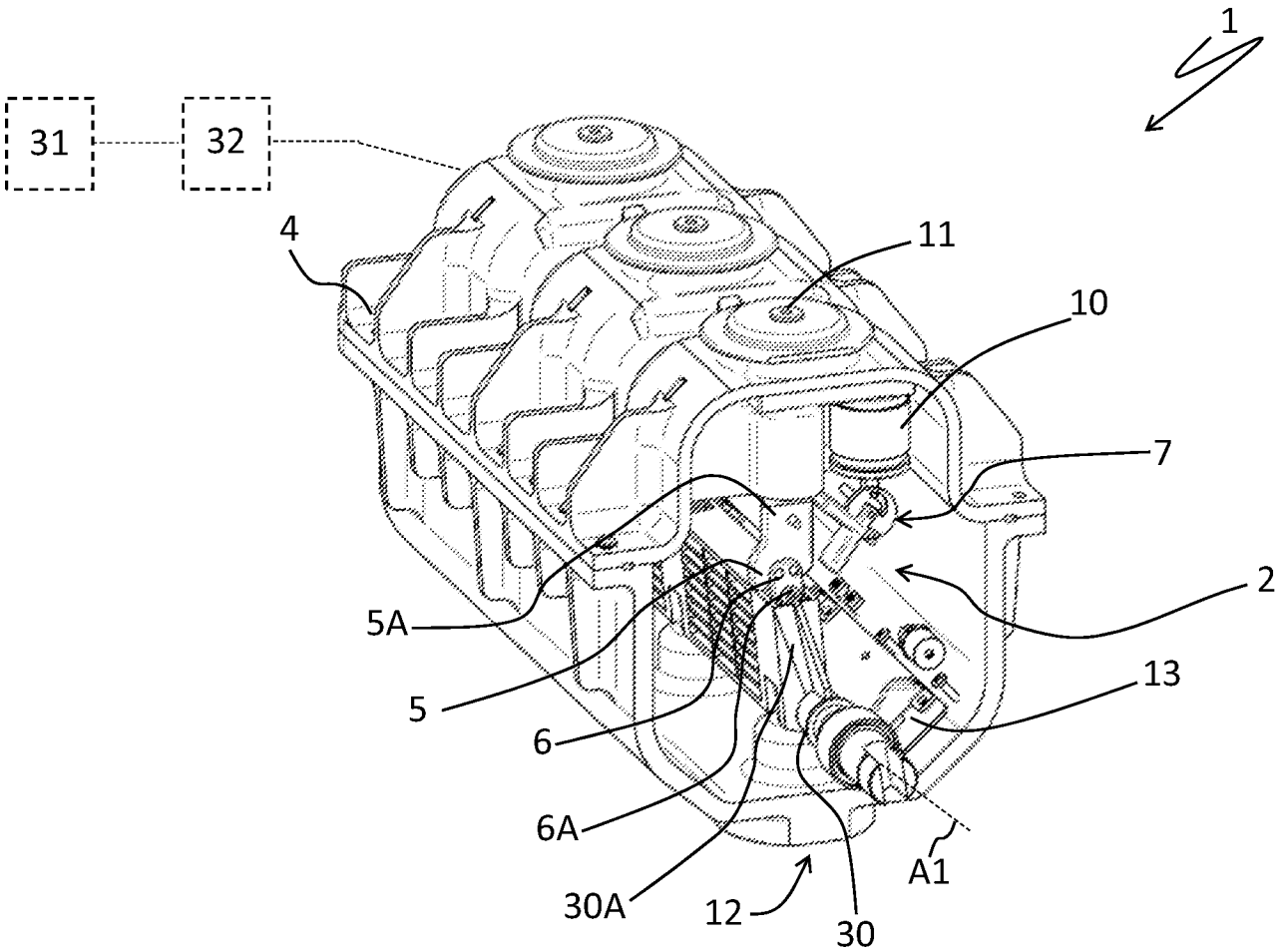
FIGS. 1-4 are schematic views of an embodiment of the switching apparatus, according to the present disclosure.

The insulating housing 4 may have an elongated shape (e.g. substantially cylindrical) developing along a main longitudinal axis (FIG. 1). The electric poles 2 are arranged side by side along corresponding transversal planes perpendicular the main longitudinal axis of the switching apparatus.

In general, the insulating housing 4 of the switching apparatus may be realized according to solutions of known type. Therefore, in the following, it will be described only in relation to the aspects of interest of the present disclosure, for the sake of brevity.

The internal volume of the switching apparatus 1 is filled with pressurized dry air or another insulating gas having a low environmental impact, such as mixtures of oxygen, nitrogen, carbon dioxide and/or fluorinated gases.

For each electric pole 2, the switching apparatus 1 includes a first pole terminal 11, a second pole terminal 12 and a ground terminal 13.

The first pole terminal 11 is adapted to be electrically coupled to a first conductor of an electric line (e.g. a phase conductor electrically connected to an equivalent electric power source), the second pole terminal 12 is adapted to be electrically connected to a second conductor of an electric line (e.g. a phase conductor electrically connected to an equivalent electric load) while the ground pole terminal 13 is adapted to be electrically connected to a grounding conductor.

In general, the terminals 11, 12, 13 of each electric pole 2 of the switching apparatus may be realized according to solutions of known type. Therefore, in the following, they will be described only in relation to the aspects of interest of the present disclosure, for the sake of brevity.

For each electric pole 2, the switching apparatus 1 includes an electrically conductive first fixed contact member 5A including at least a first fixed contact 5.

Figure 4:
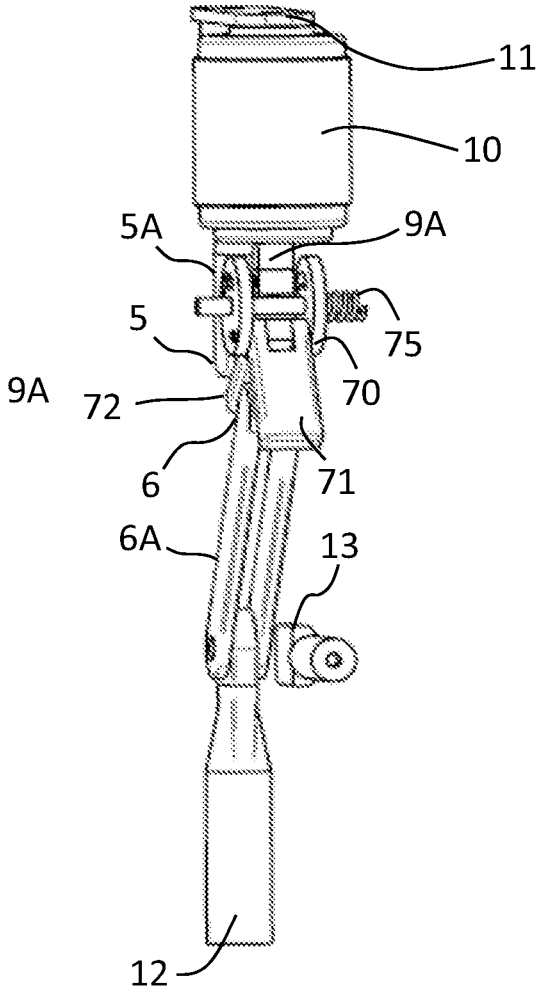

The first fixed contact member 5A is at least partially made of an electrically conductive material and it is electrically connected to the first pole terminal 11. As shown in cited figures, the first fixed contact member 5A may be conveniently formed by an elongated piece of conductive material having one end coupled to the first pole terminal 11 and an opposite blade-shaped free end (FIG. 4), which forms the first fixed contact 5.

In principle, however, the first fixed contact member 5A may be realized according to other solutions of known type (e.g. according to a multiple-blade configuration including multiple fixed contacts), which are here not described in detail for the sake of brevity.

For each electric pole 2, the switching apparatus 1 includes a first movable contact member 6A including at least a first movable contact 6.

The first movable contact member 6A is at least partially made of an electrically conductive material and it is electrically connected to the second pole terminal 12.

The first movable contact member 6A is reversibly movable (along a given plane of rotation) about a corresponding first rotation axis A1, which is substantially parallel to the main longitudinal axis of the switching apparatus.

The first movable contact member 6A can rotate according to a first rotation direction R1, which is oriented away from the first fixed contact 5 and towards the ground terminal 13, or according to a second rotation direction R2, which is opposite to the first rotation direction R1 and is oriented away from the ground terminal 13 and towards the first fixed contact 5.

Figure 2:
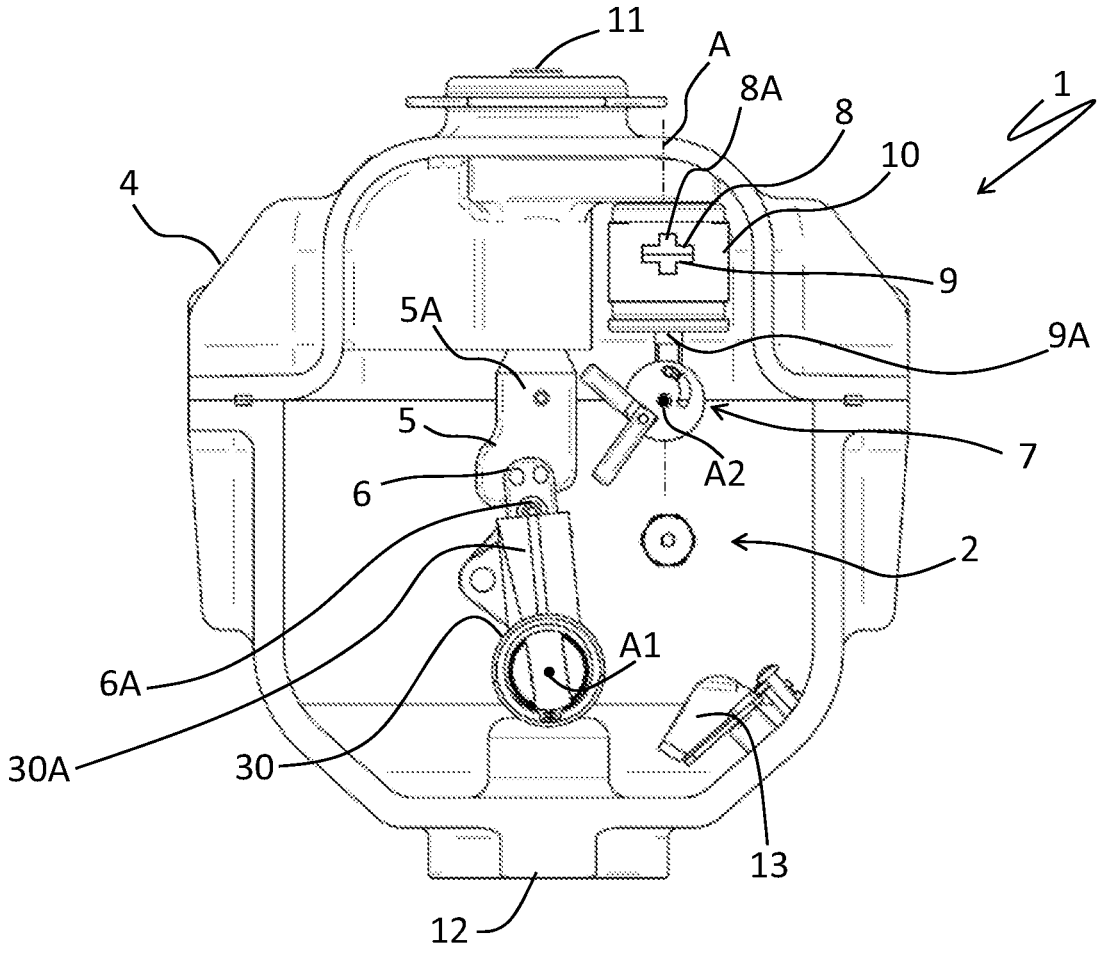

With reference to an observation plane of FIG. 2, the above-mentioned first rotation direction R1 is oriented clockwise while the above-mentioned second rotation direction R2 is oriented counter-clockwise.

As it will better illustrated in the following, the first movable contact member 6A moves according to the first rotation direction R1 during an opening maneuver or a disconnecting maneuver of the switching apparatus and it moves according to the second rotation direction R2 during a closing maneuver or a reconnecting maneuver of the switching apparatus.

As the first movable contact member 6A is reversibly movable about the first rotation axis A1, the first movable contact 6 can be coupled to or uncoupled from the first fixed contact 5 or it can be coupled to or uncoupled from the ground terminal 13.

As shown in cited figures (FIG. 4), the first movable contact member 6A may be formed by a pair of blades of conductive material. Each blade has an end hinged to the second terminal 12 of the corresponding electric pole at the first rotation axis A1 and an opposite free end forming a movable contact 6. In this way, each movable contact 6 can be coupled to or uncoupled from a corresponding coupling surface of the blade-shaped portion of the first fixed member 5A, which forms the first fixed contact 5.

In principle, however, the first movable contact member 6A may be realized according to other solutions of known type (e.g. according to a single-blade configuration including a single movable contact), which are here not described in detail for the sake of brevity.

As it will be apparent from the following, for each electric pole 2, the electric contacts 5, 6 operates as main electric contacts, through which a current IL flowing between the first and second pole terminals 11, 12 passes when the switching apparatus is in a closed state or at an initial stage of an opening maneuver.

The switching apparatus 1 may include an actuation assembly providing suitable actuation forces to actuate the movable contact members 6A of the electric poles (FIG. 1).

Such an actuation assembly may include a motion transmission shaft 30 made of electrically insulating material, which can rotate about the first rotation axis A1 and it is coupled to the first movable contact members 6A of the electric poles 2.

The motion transmission shaft 30 thus provides rotational mechanical forces to actuate the firstmovable contact members 6A during the maneuvers of the switching apparatus.

As shown in the cited figures, the motion transmission shaft 30 may include suitable coupling seats 30A, in which the first movable contact members 6A are accommodated and solidly coupled to the motion transmission shaft.

The actuation assembly 3 may include an actuator 31 coupled to the transmission shaft 3 through a suitable kinematic chain 32. The actuator 31 may be, for example, a mechanical actuator, an electric motor or an electromagnetic actuator.

In general, the actuation assembly 3 of the switching apparatus may be realized according to solutions of known type. Therefore, in the following, it will be described only in relation to the aspects of interest of the present disclosure, for the sake of brevity.

For each electric pole 2, the switching apparatus 1 includes a second fixed contact member 8A including at least a second fixed contact 8.

The second fixed contact member 8A is at least partially made of an electrically conductive material and it is electrically connected to the first pole terminal 11. The second fixed contact member 8A may be positioned in parallel to the first fixed contact member 5A along a same reference plane (e.g. the plane of rotation of the first movable contact member 6A).

The second fixed contact member 8A may be formed by an elongated piece of conductive material having one end coupled to the first pole terminal 11 and an opposite free end forming the second fixed contact 8.

In principle, however, the second fixed contact member 8A may be realized according to other solutions of known type (e.g. a multi-blade configuration), which are here not described in detail for the sake of brevity.

For each electric pole 2, the switching apparatus 1 includes a second movable contact member 9A including at least a second movable contact 9.

The second movable contact member 9A is reversibly movable along a corresponding translation axis A, which may be parallel to the first fixed contact member 5A along a same reference plane (e.g. the plane of rotation of the first movable contact member 6A) and perpendicular to the rotation axis A1 of the first movable contact member 6A.

The second movable contact member 9A is reversibly movable along the displacement axis A, so that the second movable contact 9 can be coupled to or uncoupled from the second fixed contact 8. In particular, the second movable contact member 9A is reversibly movable along the displacement axis A between a coupling position P1, at which the second movable contact 9 is coupled to the second fixed contact 8, and a decoupled position P2, at which the second movable contact 9 is decoupled from the second fixed contact 8.

The second movable contact member 9A may be formed by an elongated piece of conductive material having one end 90 coupled to a further mechanical element 70 and an opposite free end forming the second mobile contact 9.

In principle, however, the second mobile contact member 9A may be realized according to other solutions of known type (e.g. a multi-blade configuration), which are here not described in detail for the sake of brevity.

As it will be apparent from the following, for electric pole 2, the electric contacts 8, 9 operate as shunt electric contacts, through which a current IL flowing between the first and second pole terminals 11, 12 is deviated at least partially during certain transitory stages of an opening maneuver of the switching apparatus.

According to the present disclosure, for each electric pole 2, the switching apparatus 1 includes a vacuum chamber 10, in which a vacuum atmosphere is present.

Conveniently, the second fixed contact 8 and the second movable contact 9 are enclosed in the vacuum chamber 10 and they are mutually coupled or decoupled inside said vacuum chamber, therefore being permanently immersed in a vacuum atmosphere.

The vacuum chamber 10 may be realized according to solutions of known type. Therefore, in the following, it will be described only in relation to the aspects of interest of the present disclosure, for the sake of brevity.

According to the present disclosure, for each electric pole 2, the switching apparatus 1 includes a motion transmission mechanism 7 for actuating the second movable contact member 9A.

The motion transmission mechanism 7 includes a cam member 70, which may be pivoted on fixed support (not shown), for example the insulating housing 4.

The cam member 70 is reversibly movable about a second rotation axis A2, according to a third rotation direction R3 or a fourth rotation direction R4, opposite to said third rotation direction.

With reference to an observation plane of FIG. 2, the above-mentioned third rotation direction R3 is oriented counter-clockwise while the above-mentioned fourth rotation direction R4 is oriented clockwise.

The cam member 70 is coupled to the second movable contact member 9A and it is arranged in such a way to exert actuation forces on the second movable contact member 9A when it rotates about the second rotation axis A2. Said actuation forces are directed along the translation axis A and reversibly move the second movable contact member 9A between the above-mentioned first and second coupling positions P1, P2.

According to some embodiments of the present disclosure, the cam member 70 includes one or more coupling surfaces 70A with the second movable contact member 9A, which conveniently have an eccentric profile with respect to the second rotation axis A2. In this way, it can move the second movable contact member 9A along the translation axis A, when it rotates about the second rotation axis A2.

Figure 3:
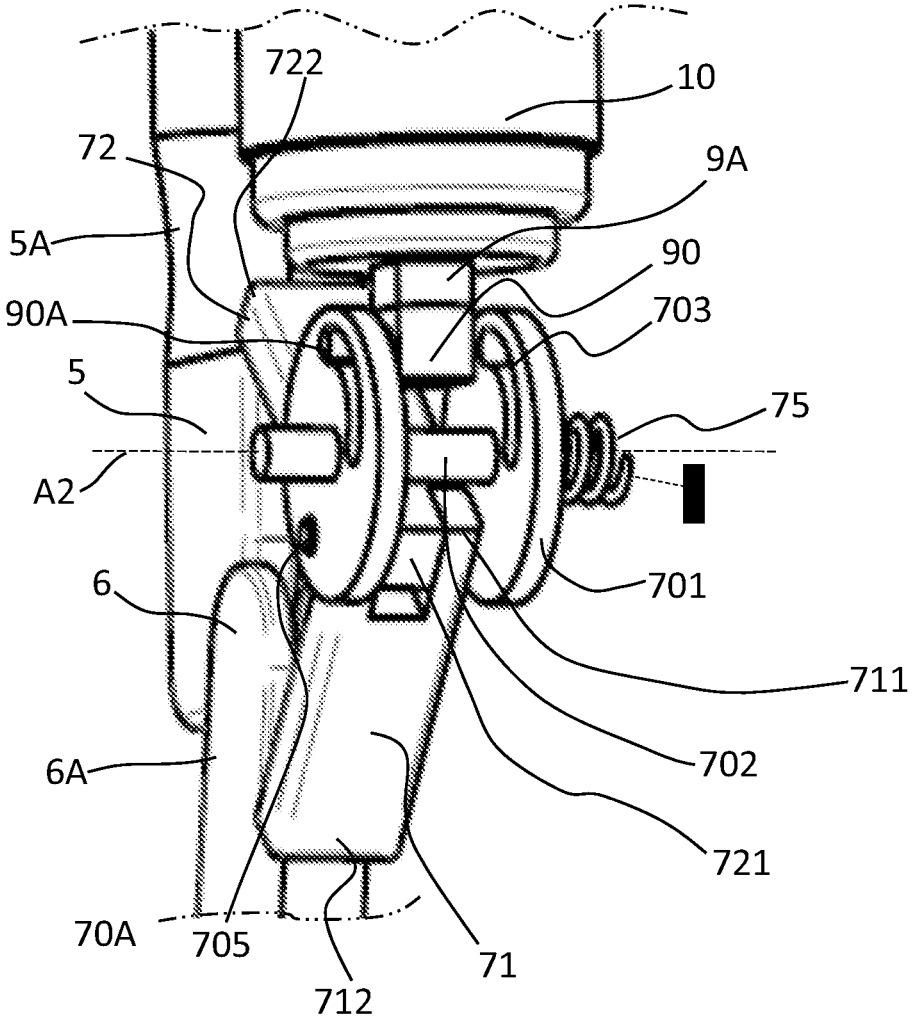

FIG. 3 shows an embodiment of the present disclosure, in which the cam member 70 includes a pair of parallel discs 701 joined by a coupling pin 702 arranged along the second rotation axis A2 and pivoted on the above-mention fixed support (not shown).

Each disc 701 includes a slot 703 having an eccentric profile with respect to the second rotation axis A2 and may be arranged in proximity of the external edge of said disk.

At the free end 90, the second movable contact member 9A includes a pair of pins 90A protruding from opposite sides of said second movable contact member. Each pin 90A is conveniently coupled to a corresponding slot 703 of a disc 701.

It is evident that the surfaces of the discs 701, which define the slots 703, form coupling surfaces 70A with the second movable contact member 9A, which conveniently have an eccentric profile with respect to the second rotation axis A2.

As the skilled person can certainly understand, the cam member 70 may be realized according to a variety of solutions of different type falling within the scope of the present disclosure.

As an example, the cam member 70 may include a single disc 701 arranged as shown in FIG. 3 and coupled to a single pin 90A protruding from the free end 90 of the second movable contact member 9A.

As a further example, the cam member 70 may formed by a solid body having an eccentric shape with respect to the second rotation axis A2.

As a further example, the cam member 70 may include one or more motion transmission elements coupled to the second movable contact member 9A by means of suitable kinematic chains of the crank-lever arm type.

The cam member 70 is electrically conductive and electrically connected to the second movable contact member 9A.

The cam member 70 may be made of one or more shaped pieces of electrically conductive material.

As an alternative, the cam member 70 may include also parts made of electrically insulating material provided that a conductive path towards the second movable contact member 9A is ensured.

The motion transmission mechanism 7 includes a first lever arm 71 and a second lever arm 72 coupled to the cam member 70 and extending radially with respect to the second rotation axis A2.

As shown in the cited figures, each lever arm 71, 72 is formed by an elongated piece of material having a coupling end 711, 721 coupled to the cam member 70 and an opposite free end 712, 722 in distal position with respect to said cam member.

Referring to the embodiment shown in FIG. 3, the lever arms 71, 72 have coupling ends 711, 721 (which may have complementary shapes) coupled to an additional coupling pin 705 of the cam member 70, which joins the parallel disks 701 in proximity of the external edges of these latter.

The additional coupling pin 705 is conveniently arranged along an axis parallel to the second rotation axis A2.

As an alternative, the lever arms 71, 72 may have coupling ends 711, 721 directly linked to the coupling pin 702 of the cam member 70.

Conveniently, the first and second lever arms 71, 72 are angularly spaced one from another, for example of an angle of 90° measured on a reference plane perpendicular to the second rotation axis A2.

Conveniently, the first lever arm 71 is electrically conductive and electrically connected to the cam member 70. In this way, the presence of an electric path from the first lever arm 71 to the second movable contact member 9A, which passes through the cam member 70, is ensured.

According to some embodiments of the present disclosure, the first lever arm 71 is made of electrically conductive material.

As an alternative, the first lever arm 71 may include also parts made of electrically insulating material provided that the presence of a conductive path towards the cam member 70 is ensured.

Figure 5:
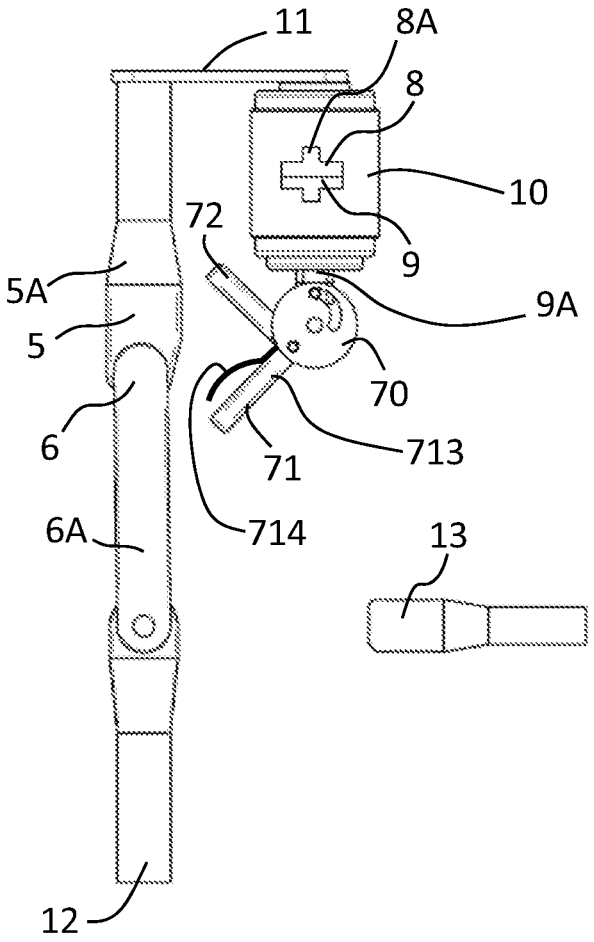
FIG. 5 is a schematic view of a further embodiment of the switching apparatus, according to the present disclosure.

According to other embodiments of the present disclosure (FIG. 5), the first lever arm 71 includes a main body 713 and a conductive element 714 coupled to said main body, and may be coupled in such a way to protrude from this latter.

The conductive element 714 is electrically connected with the cam member 70 (for example to the additional coupling pin 705) or with a conductive portion of the main body 713, which in turn is electrically connected with the cam member 70.

The conductive element 714 is conveniently arranged in such a way to be contact with the first movable contact member 6A, when this latter is coupled to the first lever arm 71.

In this way, the presence of a conductive path between the first movable contact member 6A and the second movable contact member 9A, which passes through the first lever arm 71 and the cam member 70, is ensured, when the first movable contact member 6A is coupled to the first lever arm 71.

The conductive element 714 may be made of a leaf spring having a free end and an opposite end linked to the cam member 70 or another conductive portion of the first lever arm 71.

This solution is quite advantageous as it ensures a softened coupling between the first movable contact member 6A and the first lever arm 71 during the maneuvers of the switching apparatus and, at the same time, an electrical connection with the second movable contact member 9A.

As the conductive element 76 ensures the presence of a conductive path towards the cam member 70, according to these embodiments of the present disclosure, the main body 713 of the first lever arm 71 may be integrally made of electrically insulating material.

However, also in these embodiments of the present disclosure, the first lever arm 71 may still be made, at least partially, of electrically conductive material, as mentioned above.

The said second lever arm 72 may be made of electrically insulating material.

According to the present disclosure, the cam member 70 is movable between a first switch position S1, which corresponds to a coupling position P1 of the second movable contact member 9A, and a second switch position S2, which corresponds to a decoupled position P2 of the second movable contact member 9A.

The switching of the cam member 70 in the first switch position S1 or the second switch position S2 occurs upon actuation of the first lever arm 71 or the second lever arm 72 by the first movable contact member 6A, during an opening or closing maneuver of the switching apparatus.

According to example embodiments of the present disclosure, the first movable contact member 6A couples to and actuates the first lever arm 71 to move the cam member 70 from the first switch position S1 to the second switch position S2, according to the third rotation direction R3, when the first movable contact member 6A moves according to a first rotation direction R1, during an opening maneuver of the switching apparatus.

Since the first electric arm 71 is conductive and electrically connected with the cam member 70, which, in turn, is conductive and electrically connected with the second movable contact member 9A, the motion transmission mechanism 7 electrically connects the second movable contact member 9A with the first movable contact member 6A, when this latter is coupled to the first lever arm 71.

Conveniently, the first movable contact member 6A couples to and actuates the second lever arm 72 to move the cam member 70 from the second switch position S2 to the first switch position S1, according to the fourth rotation direction R4, when the first movable contact member moves according to a second rotation direction R2, during a closing maneuver of the switching apparatus.

In this case, for example due to the fact that the second electric arm 72 may be made of electrically insulating material, the motion transmission mechanism 7 provides a galvanic separation between the second movable contact member 9A and the first movable contact member 6A, when this latter is coupled to the second lever arm 72.

The motion transmission mechanism 7 may include biasing means 75 to favor the switch of the cam member 70 in the first switch position S1 or said second switch position S2, when the first lever arm 71 or the second lever arm 72 is actuated by the first movable contact member 6A.

Conveniently, during an opening of the switching apparatus, the biasing means 75 cooperate with the first movable contact member 6A to actuate the first lever arm 71, while the cam member 70 is moving from the first switch position S1 to the second switch position S2, according to the third rotation direction R3, Similarly, during a closing maneuver of the switching apparatus, the biasing means 75 cooperate with the first movable contact member 6A to actuate the second lever arm 72, while the cam member 70 is moving from the second switch position S2 to the first switch position S1, according to the fourth rotation direction R4.

According to some embodiments of the present disclosure, the biasing means 75 may be of mechanical type. In this case (FIG. 3), they may include one or more insulating springs coupled to the cam member 70 (for example at the coupling pin 702) and a fixed support (e.g. the insulating housing 4 or the first fixed contact member).

As an alternative (not shown), the biasing means 75 may include one or more first insulating springs coupled to the first lever arm 71 and to a first fixed support and one or more second insulating springs coupled to the second lever arm 72 and to a second fixed support.

According to other embodiments of the present disclosure (not shown), the biasing means 75 may be of the magnetic type. In this case, they may include one or more first magnetic elements coupled to the first lever arm 71 and to a first fixed support and one or more second magnetic elements coupled to the second lever arm 72 and to a second fixed support.

According to the present disclosure, in operation, the switching apparatus 1 is capable of switching in three different operating states.

In particular, the switching apparatus 1 can switch in:

a closed state, in which each electric pole 2 has the first and second pole terminals 11, 12 electrically connected one to another and electrically disconnected from the ground terminal 13. When the switching apparatus is in a closed state, a current can flow along each electric pole 2 between the corresponding first and second pole terminals 11, 12; or an open state, in which each electric pole 2 has the first and second pole terminals 11, 12 and the ground terminal 13 electrically disconnected one from another. When the switching apparatus is in an open state, no currents can flow along the electric poles 2; or a grounded state, in which each electric pole 2 has the first and second pole terminals 11, 12 electrically disconnected one from another and the second pole terminal 12 and the ground terminal 13 electrically connected one to another. When the switching apparatus is in a grounded state, no currents can flow along the electric poles 2. In addition, the second pole terminal 12 of each electric pole (and therefore the second line conductor connected thereto) is put at a ground voltage.

In operation, the switching apparatus 1 is capable of carrying out different type of maneuvers, each corresponding to a given transition among the above-mentioned operating states.

In particular, the switching apparatus 1 is capable of carrying out:

an opening maneuver when it switches from a closed state to an open state; or a closing maneuver when it switches from an open state to a closed state; or a disconnecting maneuver when it switches from an open state to a grounded state; or a reconnecting maneuver when it switches from a grounded state to an open state.

The switching apparatus 1 can switch from a closed state to a grounded state by carrying out an opening maneuver and subsequently a disconnecting maneuver.

Similarly, the switching apparatus 1 can switch from a grounded state to a closed state by carrying out a reconnecting maneuver and subsequently a closing opening maneuver.

In order to carry out the above-mentioned maneuvers of the switching apparatus, the above-mentioned motion transmission shaft 30 suitably drives the first movable contact member 6A of each electric pole according to the above-mentioned first rotation direction R1 or second rotation direction R2.

In general, upon actuation by the motion transmission shaft 52, the first movable contact member 6A of each electric pole is reversibly movable between a first end-of-run position PA, which corresponds to a closed state of the switching apparatus, and a second end-of-run position Pc, which corresponds to a grounded state of the switching apparatus.

Conveniently, the first motion transmission member passes through an intermediate position PB, which corresponds to an open state of the switching apparatus, when it moves between the first and second end-of-run positions $P_A$, $P_C$ (FIGS. 6-12).

The operation of the switching apparatus 1 for each electric pole 2 is now described in more detail.

Closed state of the switching apparatus

Figure 6:
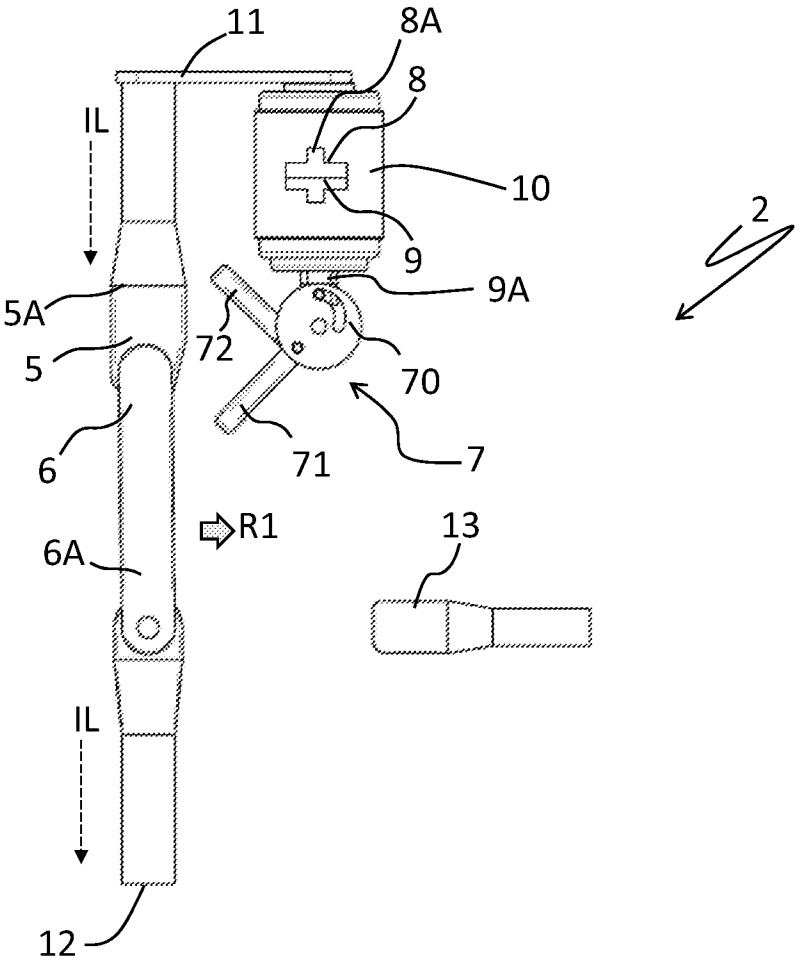
FIGS. 6-12 are schematic views to illustrate operation of the switching apparatus, according to the present disclosure.
Figure 7:
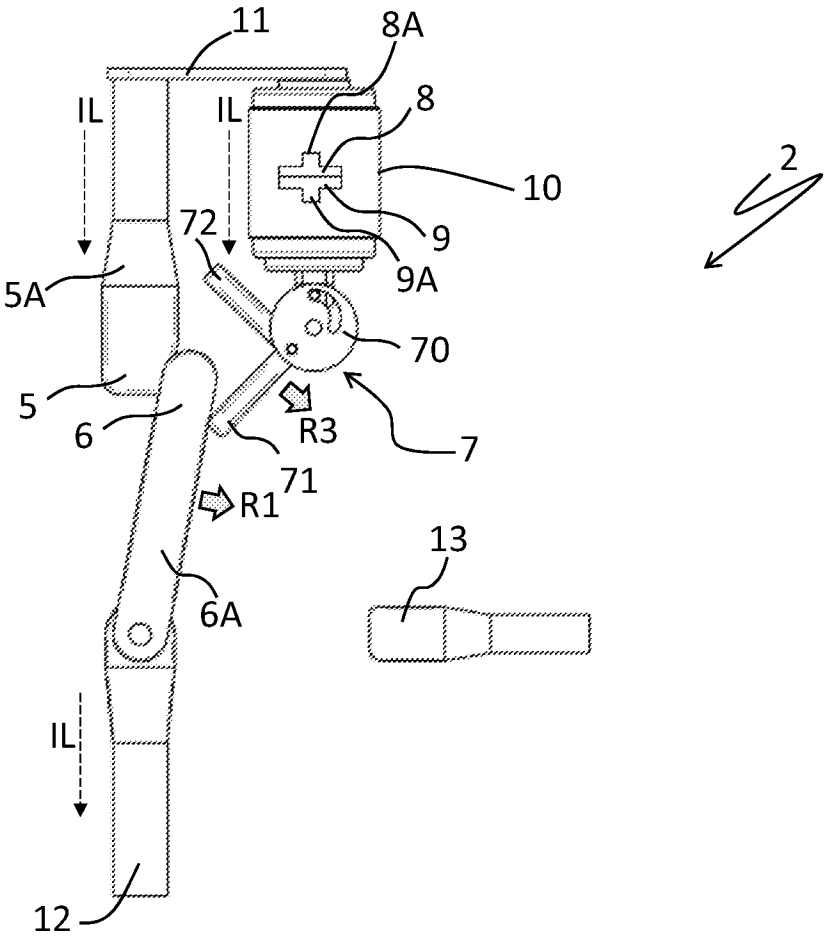
Figure 8:
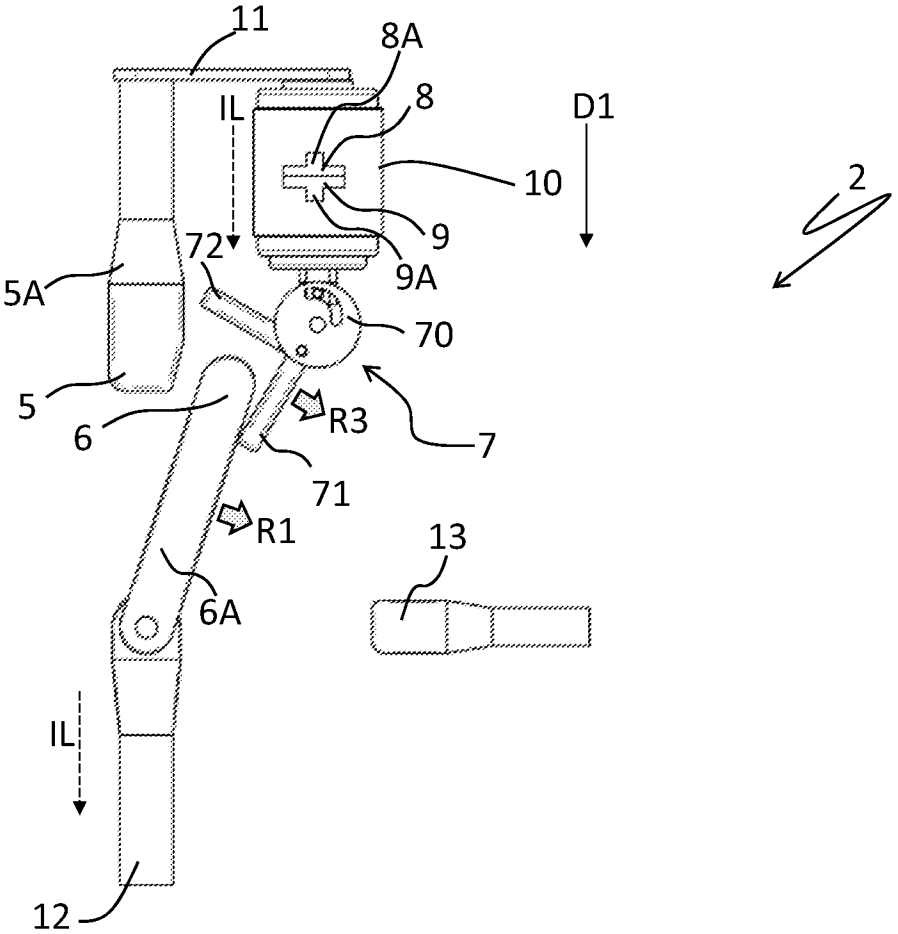

When the switching apparatus is in a closed state, each electric pole 2 is in the operating condition (first stable condition C1) illustrated in FIG. 6.

In this situation, the first movable contact member 6A is in the first end-of-run position $P_A$, the first movable contact 6 is coupled to the first fixed contact 5 and the second movable contact 9 is in the coupling position P1, i.e. coupled to the second fixed contact 8.

The cam member 70 is in the first switch position S1 and the first and second lever arms 71, 72 are decoupled from the first movable contact member 6A.

The first lever arm 71 is positioned in such a way to be actuated by the first movable contact member 6A when this latter moves away from the first fixed contact member 5A by rotating along the first rotation direction R1. In practice, the first lever arm 71 is positioned along the motion trajectory of the first movable contact member 6A when this latter away from the first end-of-run position PA.

When an electric pole 2 is in the first stable condition C1, a current IL can flow between the first and second pole terminals 11, 12 passing through the main electric contacts 5, 6. No current flows through the shunt electric contacts 8, 9.

Open state of the switching apparatus

Figure 9:
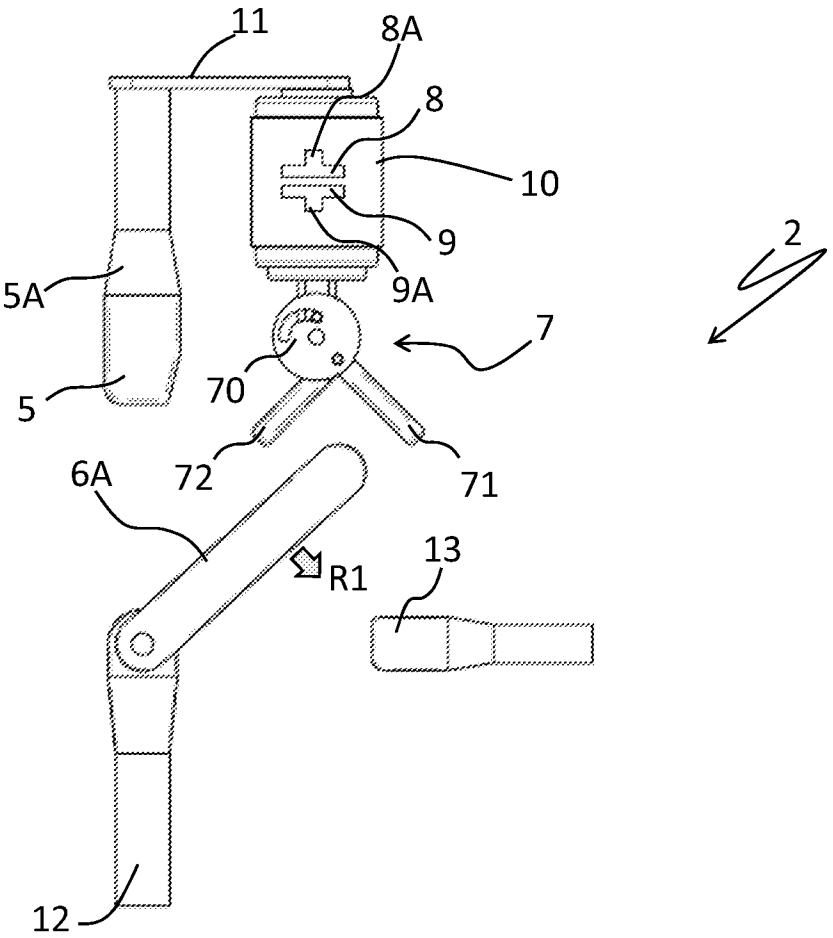

When the switching apparatus is in an open state, each electric pole 2 is in the condition (second stable condition C2) illustrated in FIG. 9.

In this situation, the first movable contact member 6A is in the intermediate position PB, the first movable contact 6 is decoupled from the first fixed contact 5 and the second movable contact 9 is in the decoupled position P2, i.e. decoupled from the second fixed contact 8.

The cam member 70 is in the second switch position S2 and the first and second lever arms 71, 72 are decoupled from the first movable contact member 6A.

When an electric pole 2 is in the second stable condition C2, no current flows along it between the first and second pole terminals 11, 12.

Grounded state of the switching apparatus

Figure 10:
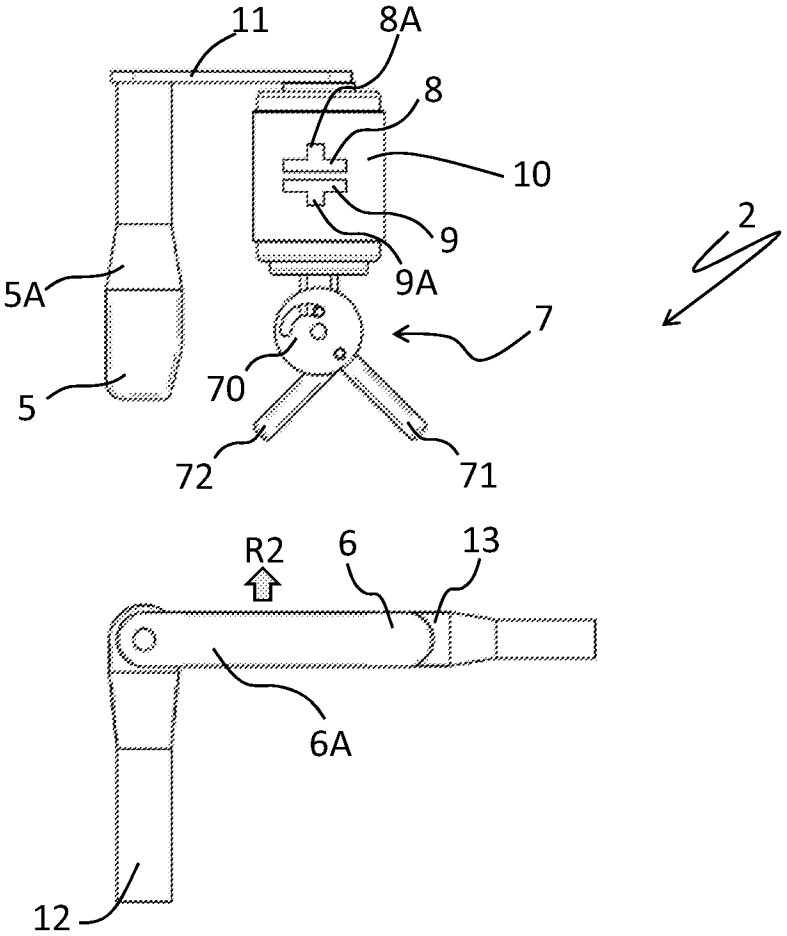

When the switching apparatus is in a grounded state, each electric pole 2 is in the condition (third stable condition C3) illustrated in FIG. 10.

In this situation, the first movable contact member 6A is in the second end-of-run position $P_B$, the first movable contact 6 is decoupled from the first fixed contact 5 and coupled to the ground terminal 13 and the second movable contact 9 is in the decoupled position P2, i.e. decoupled from the second fixed contact 8.

The cam member 70 is in the second switch position S2 and the first and second lever arms 71, 72 are decoupled from the first movable contact member 6A.

The first movable contact member 6A electrically connects the pole terminal 12 with the ground terminal 13.

When an electric pole 2 is in the third stable condition C3, no current flows along it between the first and second pole terminals 11, 12 and the second pole terminal 12 is put at a ground voltage.

Opening Maneuver

The switching apparatus 1 carries out an opening maneuver, when it switches from the closed state to the open state. Therefore, initially, each electric pole 2 is in the above-illustrated first stable condition C1 (FIG. 6).

During an opening maneuver of the switching apparatus, the first movable contact member 6A moves, according to the first rotation direction R1, between the first end-of-run position PA and the intermediate position PB. The first movable contact member 6A thus moves away from the corresponding first fixed contact member 5A.

When the first movable contact member 6A starts moving according to the first rotation direction R1, the first movable contact 6 starts decoupling from the first fixed contact 5.

However, the first lever arm 71 is positioned along its motion trajectory towards the intermediate position PB in such a way that, upon an initial movement, the first movable contact member 6A couples with the first lever arm 71 before the first movable contact 6 is completely decoupled from the first fixed contact 5.

At this stage of the opening maneuver, upon an initial movement of the first movable contact member 6A, each electric pole 2 thus switches from the first stable condition C1 (FIG. 6) to a first transitory condition C11 (FIG. 7), in which the first movable contact 6 is still coupled with the first fixed contact 5, the second movable contact 9 is in the coupled position P1, i.e. coupled to the second fixed contact 8, and the first lever arm 71 is coupled to the movable contact member 6A. In this situation, the first lever arm 71 and the cam member 70 electrically connect the first movable contact member 6A with the second movable contact member 9A (and therefore the first movable contact 6 with the second movable contact 9 and the second fixed contact 5).

When an electric pole 2 is in the first transitory condition C11, the current IL, which initially flows along said electric pole, is partially deviated to the shunt electric contacts 8, 9 and it can flow between the first and second pole terminals 11, 12 passing through the main contacts 5, 6 and the shunt contacts 8, 9 in parallel. Obviously, most of the current will flow along the main electric contacts 5, 6 as such an electric path has a lower equivalent resistance due to the larger size of the contact members 5A, 6A with respect to the contact members 8A, 9A.

When it couples to the first contact arm 71, the first movable contact member 6A starts actuating this latter and moving the cam member 70 according to the third rotation direction R3, away from the first switch position S1 and towards the second switch position S2.

Upon a further movement towards the intermediate position $P_B$, according to the first rotation direction R1, the first movable contact 6 fully decouples from the first fixed contact 5. In the meanwhile, the first movable contact member 6A keeps on actuating the first lever arm 71 and moving the cam member 70 away from the first switch position S1 and towards the second switch position S2. In this situation, the coupling lever arm 7 exerts on the second movable contact member 9A an actuation force directed to move the second movable contact member 9A away from the second fixed contact member 8A (first translation direction D1).

At this stage of the opening maneuver, each electric pole 2 reaches a second transitory condition C12 (FIG. 8), in which the first movable contact 6 is decoupled from the first fixed contact 5, the second movable contact 9 is still coupled to the second fixed contact 8 and the movable contact member 6A is coupled to the first lever arm 71.

In this situation, the current IL, which initially flows along said electric pole, is fully deviated to the shunt electric contacts 8, 9 as no current can flow through the main electric contacts 5, 6. Since a conductive path between the pole terminals 11, 12 is still ensured, no electric arcs arise between the main electric contacts 5, 6 even if these latter are still closed one to another.

Upon a further movement towards the intermediate position PB, according to the first rotation direction R1, the first movable contact member 6A keeps on actuating the first lever arm 71 and causes (in cooperation with the biasing means 75) the cam member 70 to switch in the second switch position S2.

As the cam member 70 exerts on the second movable contact member 9A an actuation force directed to move the second movable contact member 9A away from the second fixed contact member 8A (first translation direction D1), the switch of the cam member in the switch position S2 causes the second movable contact 9 to move in a decoupled position P2, i.e. decoupled from the second fixed contact 8.

The separation of the electric contacts 8, 9 causes the rising of electric arcs between said electric contacts. However, since the electric contacts 8, 9 are immersed in a vacuum atmosphere, such electric arcs can be quenched efficiently thereby quickly leading to the interruption of the current IL flowing along the electric pole.

The current IL, which initially flows along said electric pole, is interrupted due to the separation of the electric contacts 8, 9 located within the vacuum chamber 10.

When the cam member 70 switches in the second switch position S2, the first movable contact member 6A decouples from the first lever arm 71 and, upon a further movement according to the first rotation direction R1, it reaches the intermediate position PB.

It is evident that, at this stage of the opening maneuver, each electric pole 2 has switched from the second transitory condition C12 to the second stable condition C2 (FIG. 9), which corresponds to an open state of the switching apparatus.

Closing Maneuver

The switching apparatus 1 carries out a closing maneuver, when it switches from the open state to the close state.

Before carrying out a closing maneuver, the switching apparatus may have carried a reconnecting maneuver as described in the following in order to switch in an open state.

Initially, each electric pole 2 is therefore in the above-illustrated second stable condition C2 (FIG. 9).

Figure 11:
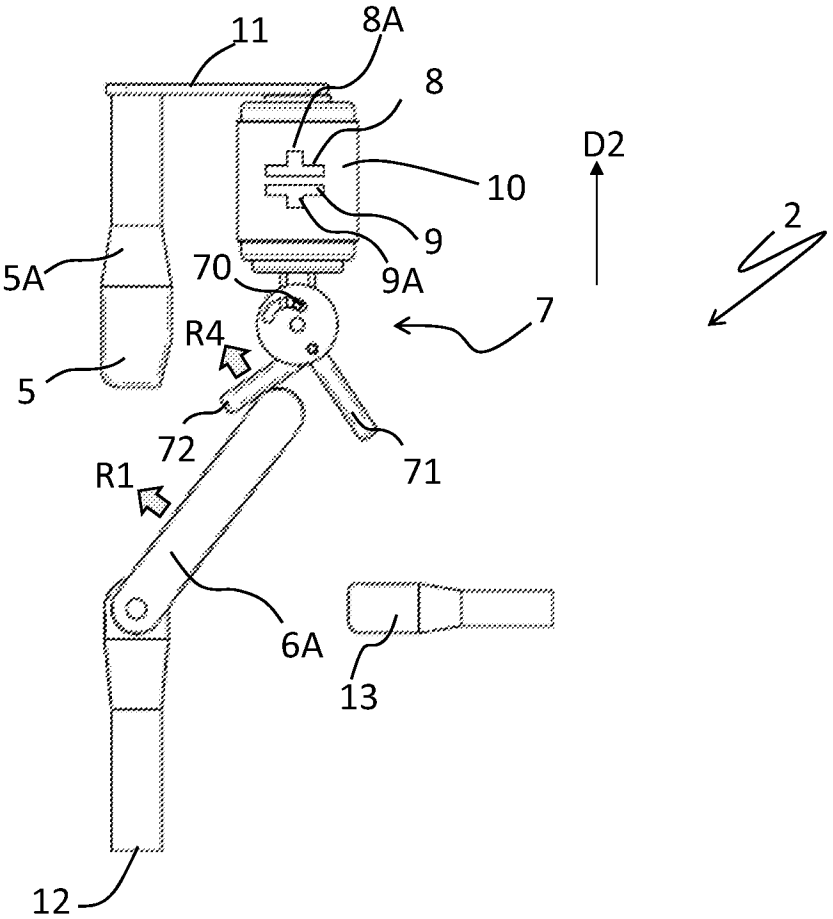
Figure 12:
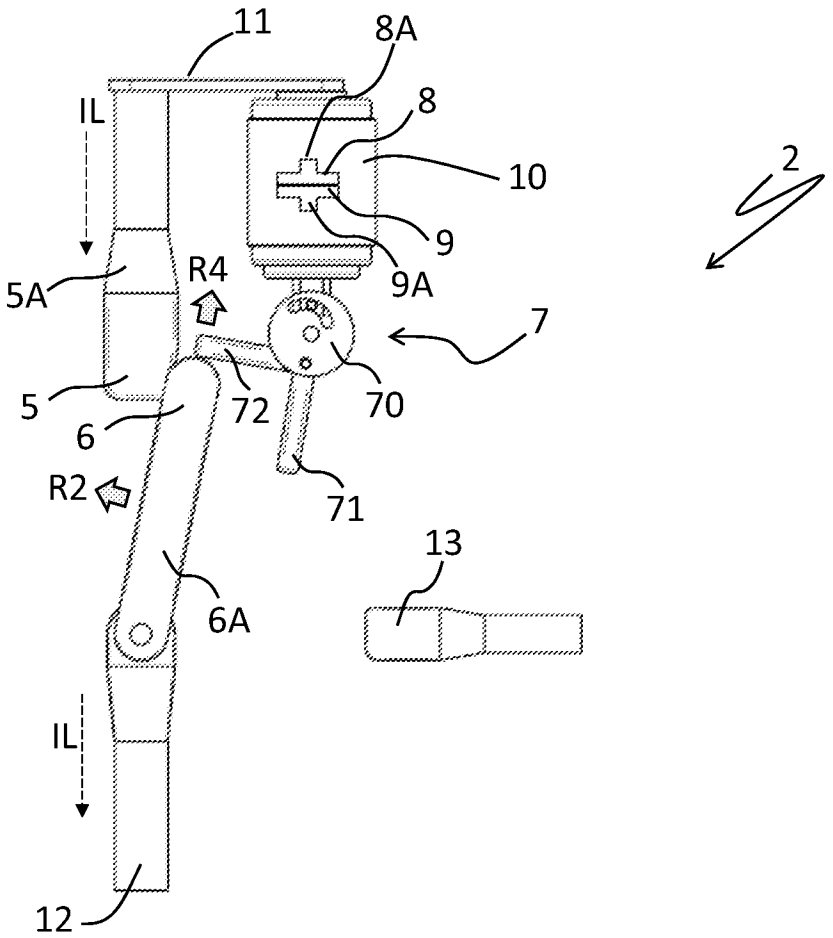

During a closing maneuver of the switching apparatus, the first movable contact member 6A moves, according to the second rotation direction R2, between the intermediate position PB and the first end-of-run position $P_A$. The first movable contact member 6A thus moves towards the first fixed contact member 5A (FIG. 11).

The cam member 70 is in the switch position S2 and the lever arms 71, 72 are initially decoupled from the first movable contact member 6A.

However, since the second lever arm 72 is positioned along its motion trajectory towards the first end-of-tun position $P_A$, upon an initial movement, the first movable contact member 6A couples with the second lever arm 72.

At this stage of the closing maneuver, each electric pole 2 reaches a transitory condition C21 (FIG. 11), in which the first movable contact 6 is decoupled from the first fixed contact 5, the second movable contact 9 is still in a decoupled position P2, i.e. decoupled from the second fixed contact 8, and the movable contact member 6A is coupled to the second lever arm 72.

In this situation, no current still flows between the first and second pole terminals 11, 12.

When it couples to the second contact arm 72, the first movable contact member 6A actuates this latter and moves the cam member 70 according to the fourth rotation direction R4, away from the second switch position S2 and towards the first switch position S2.

In this situation, the coupling lever arm 7 exerts on the second movable contact member 9A an actuation force directed to move the second movable contact member 9A towards the second fixed contact member 8A (second translation direction D2).

Upon a further movement towards the first end-of-run position $P_A$, due to the particular design of the cam member 70, the first movable contact member 6A reaches the first fixed contact member 5A before the cam member 70 switches in the second switch position S2 due to the actuation of the second lever arm 72 by the first movable contact member 6A. In this way, the first fixed contact 5 couples to the first movable contact 6 before the second movable contact 9 couples to the second fixed contact 8.

At this stage of the closing maneuver, each electric pole 2 reaches a transitory condition C22 (FIG. 12), in which the first movable contact 6 is coupled with the first fixed contact 5, the second movable contact 9 is still in a decoupled position P2, i.e. decoupled from the second fixed contact 8, and the movable contact member 6A is coupled to the second lever arm 72.

In this situation, no current IL can flow between the first and second pole terminals 11, 12 passing through the main electric contacts 5, 6. No current flows through the shunt electric contacts 8, 9.

Upon a further movement towards the first end-of-run position $P_A$, according to the second rotation direction R2, the first movable contact member 6A keeps on actuating the second lever arm 72 and causes (in cooperation with the biasing means 75) the cam member 70 to switch in the first switch position S1.

As the cam member 70 exerts on the second movable contact member 9A an actuation force directed to move the second movable contact member 9A towards the second fixed contact member 8A (second translation direction D2), the switch of the cam member 70 in the switch position S1 causes the second movable contact 9 to move in a coupling position P1, i.e. coupled with the second fixed contact 8.

When the cam member 70 switches in the first switch position S1, the first movable contact member 6A decouples from the second lever arm 72 and, upon a further movement according to the second rotation direction R2, it reaches the first end-of-run position $P_A$.

At this stage of the closing maneuver, each electric pole 2 has switched from the transitory condition C22 to the stable condition C1 (FIG. 6), which corresponds to a closed state of the switching apparatus.

Disconnecting Maneuver

The switching apparatus 1 carries out a disconnecting maneuver, when it switches from an open state to a grounded state.

Obviously, before carrying out a disconnecting maneuver, the switching apparatus has to carry out an opening maneuver as described above in order to switch in an open state.

Initially, each electric pole 2 is therefore in the above-illustrated stable condition C2 (FIG. 9).

During a disconnecting maneuver of the switching apparatus, each first movable contact member 6A moves, according to the first rotation direction R1, between the intermediate position PB and the second end-of-run position $P_C$. Each first movable contact member 6A thus moves towards the corresponding ground terminal (FIG. 10).

The first movable contact member 6A couples to the ground terminal 13, when it reaches the second end-of-run position $P_C$. In this way, the first movable contact member 6A causes the first movable contact 6 to couple to the ground terminal 13.

In this situation, the first movable contact member 6A electrically connects the second pole terminal 12 with the ground terminal 13. The second pole terminal 12 is therefore put at a ground voltage.

It is evidenced that the motion transmission mechanism 7 is not involved at all when the switching apparatus carries out a reconnecting maneuver.

Reconnecting Maneuver

The switching apparatus 1 carries out a reconnecting maneuver, when it switches from a grounded state to an open state.

Initially, each electric pole 2 is therefore in the above-illustrated stable condition C3 (FIG. 10).

During a reconnecting maneuver of the switching apparatus, each first movable contact member 6A moves, according to the second rotation direction R2, between the second end-of-run position Pc and the intermediate position PB. Each first movable contact member 6A thus moves away from the corresponding ground terminal (FIG. 10).

In this way, the first movable contact member 6A causes the first movable contact 6 to decouple from the ground terminal 13.

The first movable contact member 6A does not electrically connect the second pole terminal 12 with the ground terminal 13 anymore. The second pole terminal 12 is therefore at a floating voltage.

It is evidenced that the motion transmission mechanism 7 is not involved at all when the switching apparatus carries out a reconnecting maneuver.

Obviously, the switching apparatus has to carry out a closing maneuver as described above in order to return in a closing state.

The switching apparatus, according to the present disclosure, provides remarkable advantages with respect to the known apparatuses of the state of the art.

The switching apparatus of the present disclosure includes, for each electric pole, a simple motion transmission mechanism 7, which allows the first movable contact member 6A to drive the separation of the second movable contact 9 from the second fixed contact 8 depending on the position reached during an opening maneuver of the switching apparatus.

In this way, the breaking process of the current flowing along each electric pole can be made to occur at the electric contacts 8, 9 accommodated in the vacuum chamber 10.

Possible electric arcs, which are caused by the interruption of a current flowing along each electric pole, therefore form in a vacuum atmosphere only, which allows improving their quenching process.

The motion transmission mechanism 7 remarkably simplifies synchronization between the movement of the second movable contact member 9A and the movement of the first movable contact member 6A, during an opening maneuver or a closing maneuver of the switching apparatus.

As illustrated above, during a closing maneuver of the switching apparatus, the first movable contact member 6A reaches the first fixed contact member 5A (thereby causing the first movable contact 6 to couple to the first fixed contact 5) before the cam member 7 switches in the second switch position S2.

Additionally, the second lever arm 72 may be made of electrically insulating material.

Thanks to these arrangements, the current naturally passes through the first movable contact member 6A and the first fixed contact member 5A when the first movable contact 6 couples to the first fixed contact 5 ("making current" process).

In this condition the shunt electric contacts 8, 9 have not to carry a possible short circuit current or an overload current or, more simply, the nominal current.

This feature is quite advantageous as it allows designing a more compact vacuum chamber 10, which allows obtaining a further size and cost reduction for the overall switching apparatus.

The switching apparatus of the present disclosure has electric poles with a very compact, simple and robust structure with relevant benefits in terms of size optimization.

The switching apparatus, according to the present disclosure, ensures high-level performances in terms of dielectric insulation and arc-quenching capabilities during the current breaking process and, at the same time, it is characterised by high levels of reliability for the intended applications.

The switching apparatus, according to the present disclosure, is of relatively easy and cheap industrial production and installation on the field.

The invention claimed is:

1. A switching apparatus for medium voltage electric systems, said switching apparatus comprising one or more electric poles, wherein, for each of said one or more electric poles, said switching apparatus comprises:

a first pole terminal, a second pole terminal, and a ground terminal, said first pole terminal electrically couplable with a first conductor of an electric line, said second pole terminal electrically couplable to a second conductor of said electric line, and said ground terminal electrically couplable to a grounding conductor;

a first fixed contact member and a first movable contact member, said first fixed contact member electrically connected to said first pole terminal and including a first fixed contact, said first movable contact member electrically connected to said second pole terminal and including a first movable contact, said first movable contact member reversibly movable about a corresponding first rotation axis, so that said first movable contact can be coupled to or uncoupled from said first fixed contact or said ground terminal;

a second fixed contact member and a second movable contact member, said second fixed contact member electrically connected to said first pole terminal and including a second fixed contact, said second movable contact member including a second movable contact and reversibly movable, along a corresponding translation axis, so that said second movable contact can be coupled to or uncoupled from said second fixed contact; and a vacuum chamber, in which said second fixed contact and said second movable contact are enclosed and can be coupled or decoupled;

wherein, for each of said one or more electric poles, said switching apparatus comprises a motion transmission mechanism for actuating said second movable contact member, said motion transmission mechanism including:

a cam member movable about a second rotation axis and coupled to said second movable contact member, wherein said cam member exerts on said second movable contact member actuation forces moving said second movable contact member along said corresponding translation axis, when said cam member rotates about said second rotation axis, wherein said cam member is electrically conductive and electrically connected to said second movable contact member;

a first lever arm coupled to said cam member and extending radially with respect to said second rotation axis, wherein said first lever arm is electrically conductive and electrically connected to said second movable contact member; and a second lever arm coupled to said cam member and extending radially with respect to said second rotation axis and angularly spaced with respect to said first lever arm, wherein said cam member is movable between a first switch position, which corresponds to a coupling position of said second movable contact member with said second fixed contact member, and a second switch position, which corresponds to a decoupled position of said second movable contact member from said second fixed contact member, upon actuation of said first lever arm or said second lever arm by said first movable contact member, during an opening maneuver or a closing maneuver of said switching apparatus.

2. The switching apparatus according to claim 1, wherein:

said first movable contact member couples to and actuates said first lever arm to move said cam member from said first switch position to said second switch position, when said first movable contact member moves according to a first rotation direction, during said opening maneuver of said switching apparatus, and said first movable contact member couples to and actuates said second lever arm to move said cam member from said second switch position to said first switch position, when said first movable contact member moves according to a second rotation direction, during said closing maneuver of said switching apparatus.

3. The switching apparatus according to claim 1, wherein said motion transmission mechanism electrically connects said second movable contact member with said first movable contact member, when said first movable contact member is coupled to said first lever arm.

4. The switching apparatus according to claim 1, wherein said cam member includes one or more coupling surfaces with said second movable contact member, said coupling surfaces having an eccentric profile with respect to said second rotation axis.

5. The switching apparatus according to claim 1, wherein said first lever arm is at least partially made of electrically conductive material.

6. The switching apparatus according to claim 1, wherein said first lever arm comprises a main body and a conductive element coupled to said main body and electrically connected with said cam member or with a conductive portion of said main body electrically connected to said cam member, said conductive element in contact with said first movable contact member, when said first movable contact member is coupled to said first lever arm.

7. The switching apparatus according to claim 1, wherein said second lever arm is made of electrically insulating material.

8. The switching apparatus according to claim 1, wherein said motion transmission mechanism provides biasing to favor a switch of said cam member in said first switch position or said second switch position, when said first lever arm or said second lever arm is actuated by said first movable contact member.

9. The switching apparatus according to claim 1, wherein the first movable contact member of each of said one or more electric poles is reversibly movable between a first end-of-run position, which corresponds to a closed state of said switching apparatus, and a second end-of-run position, which corresponds to a grounded state of said switching apparatus, said first movable contact member passing through an intermediate position, which corresponds to an open state of said switching apparatus, when moving between said first end-of-run position and said second end-of-run position.

10. The switching apparatus according to claim 9, wherein, during said opening maneuver of said switching apparatus, said first movable contact member moves according to a first rotation direction between said first end-of-run position and said intermediate position, and wherein, upon an initial movement according to said first rotation direction, said first movable contact member couples to said first lever arm while remaining still in contact with said first fixed contact member, said first movable contact member actuating said first lever arm to move said cam member away from said first switch position towards said second switch position.

11. The switching apparatus according to claim 10, wherein, upon a further movement according to said first rotation direction, said first movable contact member moves away from said first fixed contact member while remaining coupled to said first lever arm, said first movable contact member actuating said first lever arm to move said cam member away from said first switch position towards said second switch position.

12. The switching apparatus according to claim 11, wherein, upon said further movement according to said first rotation direction, said first movable contact member causes said cam member to move in said second switch position by actuating said first lever arm, and wherein said first movable contact member decouples from said first lever arm and reaches said intermediate position, when said cam member switches in said second switch position.

13. The switching apparatus according to claim 9, wherein, during a disconnecting maneuver of said switching apparatus, said first movable contact member moves according to a first rotation direction between said intermediate position and said second end-of-run position, and wherein said first movable contact member couples to said ground terminal when said first movable contact member reaches said second end-of-run position, thereby causing said first movable contact to couple to said ground terminal.

14. The switching apparatus according to claim 9, wherein, during a reconnecting maneuver of said switching apparatus, said first movable contact member moves according to a second rotation direction between said second end-of-run position and said intermediate position, and wherein said first movable contact member moves away from said ground terminal, thereby causing said first movable contact to decouple from said ground terminal.

15. The switching apparatus according to claim 9, wherein, during said closing maneuver of said switching apparatus, said first movable contact member moves according to a second rotation direction between said intermediate position and said first end-of-run position, and wherein, upon an initial movement according to said second rotation direction, said first movable contact member couples to said second lever arm, thereby actuating said second lever arm to move said cam member away from said second switch position towards said first switch position.

16. The switching apparatus according to claim 15, wherein, upon said initial movement according to said second rotation direction, said first movable contact member causes said cam member to move in said first switch position by actuating said first lever arm, and wherein said first movable contact member decouples from said second lever arm and reaches said first end-of-run position, when said cam member switches in said first switch position.

17. The switching apparatus according to claim 1, wherein the switching apparatus is a load-break switch for said medium voltage electric systems.

18. A switching apparatus for medium voltage electric systems, said switching apparatus comprising one or more electric poles, wherein, for each of said one or more electric poles, said switching apparatus comprises:

a first pole terminal, a second pole terminal, and a ground terminal, said first pole terminal electrically couplable with a first conductor of an electric line, said second pole terminal electrically couplable to a second conductor of said electric line, and said ground terminal electrically couplable to a grounding conductor;

a first fixed contact member and a first movable contact member, said first fixed contact member electrically connected to said first pole terminal and including a first fixed contact, said first movable contact member electrically connected to said second pole terminal and including a first movable contact, said first movable contact member reversibly movable about a corresponding first rotation axis, so that said first movable contact can be coupled to or uncoupled from said first fixed contact or said ground terminal;

a second fixed contact member and a second movable contact member, said second fixed contact member electrically connected to said first pole terminal and including a second fixed contact, said second movable contact member including a second movable contact and reversibly movable, along a corresponding translation axis, so that said second movable contact can be coupled to or uncoupled from said second fixed contact; and a vacuum chamber, in which said second fixed contact and said second movable contact are enclosed and can be coupled or decoupled;

wherein, for each of said one or more electric poles, said switching apparatus comprises a motion transmission mechanism for actuating said second movable contact member, said motion transmission mechanism including:

a cam member movable about a second rotation axis and coupled to said second movable contact member, wherein said cam member exerts on said second movable contact member actuation forces moving said second movable contact member along said corresponding translation axis, when said cam member rotates about said second rotation axis, wherein said cam member is electrically conductive and electrically connected to said second movable contact member;

a first lever arm coupled to said cam member and extending radially with respect to said second rotation axis, wherein said first lever arm is electrically conductive and electrically connected to said second movable contact member; and a second lever arm coupled to said cam member and extending radially with respect to said second rotation axis and angularly spaced with respect to said first lever arm, wherein said second lever arm is made of electrically insulating material, and wherein said cam member is movable between a first switch position, which corresponds to a coupling position of said second movable contact member with said second fixed contact member, and a second switch position, which corresponds to a decoupled position of said second movable contact member from said second fixed contact member, upon actuation of said first lever arm or said second lever arm by said first movable contact member, during an opening maneuver or a closing maneuver of said switching apparatus.

* * * * *